United States Patent [19]

Congin et al.

[11] Patent Number: 5,058,871

[45] Date of Patent: Oct. 22, 1991

[54] EXAMINATION TABLE ASSEMBLY

[75] Inventors: James V. Congin, Solon; William F. Meditz, Mayfield Village, both of Ohio

[73] Assignee: Waygo Incorporated, Cleveland, Ohio

[21] Appl. No.: 357,325

[22] Filed: May 25, 1989

[51] Int. Cl.[5] ..... A61G 13/00

[52] U.S. Cl. ..... 269/323; 269/325

[58] Field of Search ..... 254/102, 122, 124; 269/322, 323, 324, 328, 325; 182/69; 248/277

[56] References Cited

U.S. PATENT DOCUMENTS

| | | | |
|---|---|---|---|
| 2,069,012 | 1/1937 | Lynes | 254/102 |
| 3,845,946 | 11/1974 | Warden et al. | 269/323 |
| 4,576,368 | 3/1986 | Ogawa et al. | 269/322 |
| 4,657,235 | 4/1987 | Schär | 269/322 |
| 4,690,250 | 9/1987 | Bergstrom | 254/122 |

*Primary Examiner*—J. J. Hartman

*Attorney, Agent, or Firm*—Tarolli, Sundheim & Covell

[57] ABSTRACT

An examination table assembly has a drive assembly which is operable to raise and lower a table top relative to a base. A housing encloses the drive assembly. The housing includes a plurality of relatively movable sections disposed in a telescopic relationship with each other. The housing sections are movable between a telescopically retracted condition when the table top is in a fully lowered position and a telescopically extended condition when the table top is in a fully raised position. Controls for effecting operation of the drive assembly to raise and lower the table top include a plurality of flexible conduits containing fluid. Push buttons are manually actuatable to increase the fluid pressure in the conduits to thereby effect operation of the drive assembly to either raise or lower the table. A weighing device is provided to weigh an individual disposed on the table top.

8 Claims, 4 Drawing Sheets

EXAMINATION TABLE ASSEMBLY

BACKGROUND OF THE INVENTION

An improved examination table assembly can be used during an examination of an individual and for other purposes.

When a physician examines a patient, it is a common practice to have the patient sitting or laying on an examination table. These examination tables usually have stationary table tops. The positioning of handicapped, injured, elderly or obese individuals on the examination table can involve considerable effort and may even be hazardous to the individual.

If the top of an examination table cannot be lowered to or below the level of a seat of a wheelchair, difficulty will be encountered in transferring an individual from the wheelchair to the examination table. The transferring of individuals to known examination tables requires considerable effort on the part of nursing personnel or other staff members. In addition, the placing of a handicapped individual on an examination table has, in the past, resulted in the individual falling from the table and being injured.

BRIEF SUMMARY OF THE INVENTION

The present invention relates to a new and improved examination table assembly having a table top which can be raised and lowered. A housing encloses a drive mechanism which raises and lowers the table top. The housing includes a plurality of sections which are disposed in a telescopic relationship relative with each other. When the table top is raised, the housing sections are telescopically extended. When the table top is lowered, the housing sections are telescopically contracted.

A manually actuatable control for the drive assembly is connected with the drive assembly by flexible conduits containing fluid. When the table top is to be raised or lowered, the pressure in the conduits is changed to provide a control signal which effects operation of the drive assembly to raise and lower the table top. A weighing apparatus is connected with the table top to provide an output indicative of the weight of an individual on the table top.

Accordingly, it is an object of this invention to provide a new and improved examination table assembly having a drive assembly for raising and lowering a table top and wherein the drive assembly is enclosed by a housing having sections which are telescopically movable between a retracted condition and an extended condition.

Another object of this invention is to provide a new and improved examination table assembly having a table top which can be raised and lowered by a drive assembly and wherein operation of the drive assembly is controlled by manually varying a characteristic of fluid in conduits connected with the drive assembly.

Another object of this invention is to provide a new and improved examination table assembly and wherein a weighing device is provided to weigh an individual disposed on the examination table assembly.

BRIEF DESCRIPTION OF THE DRAWINGS

The foregoing and other objects and features of the present invention will become more apparent upon a consideration of the following description taken in connection with the accompanying drawings, wherein.

DESCRIPTION OF ONE SPECIFIC PREFERRED EMBODIMENT OF THE INVENTION

General Description

Figure 1:
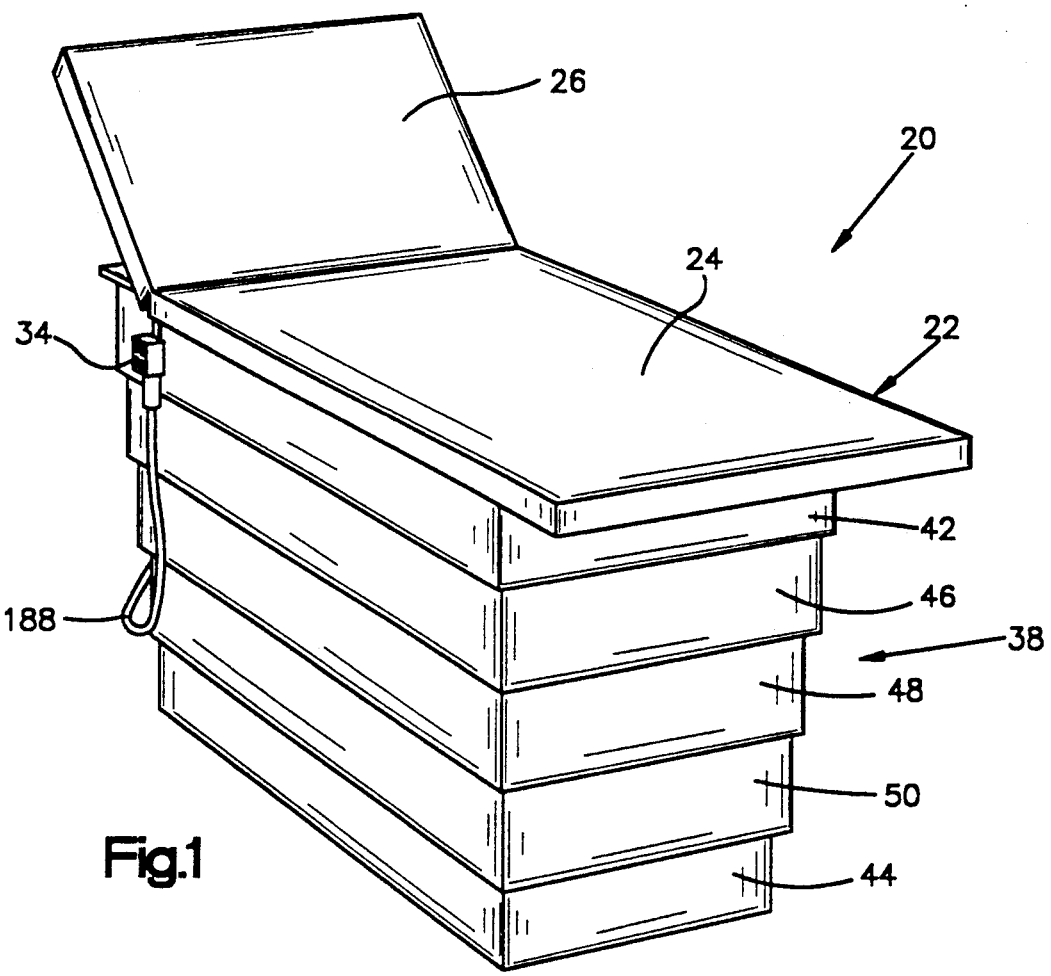
FIG. 1 is a pictorial illustration of an examination table assembly constructed in accordance with the present invention, the examination table assembly being shown in a fully raised position with a housing telescopically extended.
Figure 2:
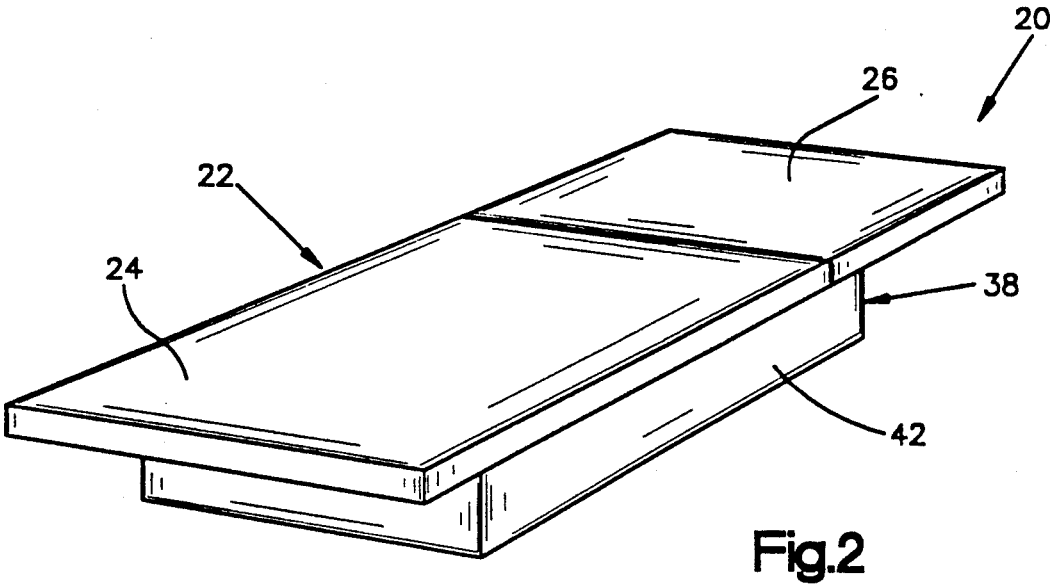
FIG. 2 is a pictorial illustration of the examination table assembly of FIG. 1 in a fully lowered position and the housing telescopically retracted.

An examination table assembly 20 is illustrated in a raised position in FIG. 1 and in a lowered position in FIG. 2. The examination table assembly 20 may be used to support an individual during a medical or other type of examination. Although it is believed that the examination table assembly 20 will be used primarily to support individuals, the table assembly could be used to support animals or objects which are to be inspected. It is contemplated that the examination table assembly 20 may be used in hospitals, physical therapy units, imaging rooms, orthopedic exam rooms, physicians offices, nursing homes, chiropractors offices, and veterinarians offices.

The examination table assembly 20 includes a table top 22 having a relatively large rectangular main section 24 and a backrest 26. The backrest 26 is movable from the fully lowered or horizontal position of FIG. 2 through the partially raised position of FIG. 1 to a fully raised position in which the backrest 26 extends vertically upwardly from the main section 24. A drive assembly 30 (FIGS. 3, 4, 5 and 10) is connected with the table top 22 and with a base 32.

Figure 3:
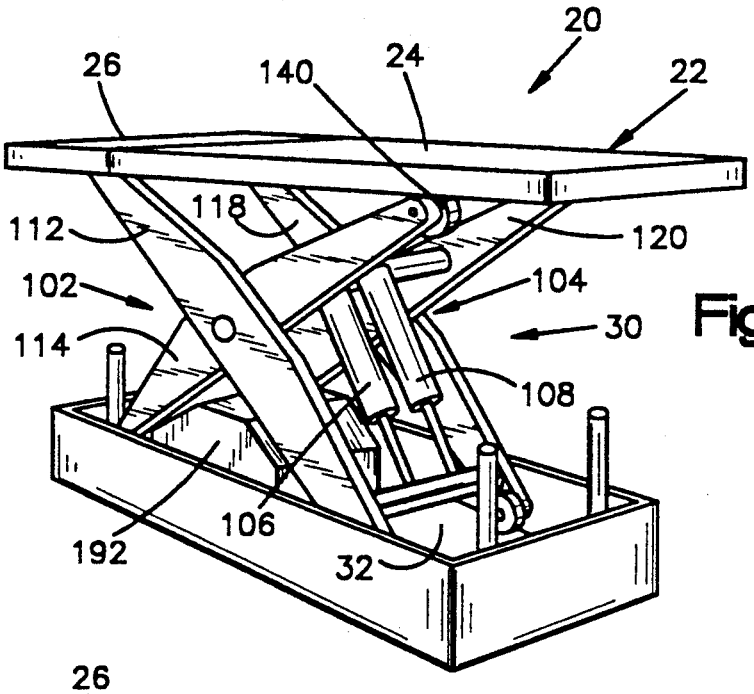
FIG. 3 is a pictorial illustration of the examination table assembly with the housing removed to illustrate the relationship between components of a drive assembly which raises and lowers a table top, the examination table assembly being shown in the fully raised position of FIG. 1.
Figure 5:
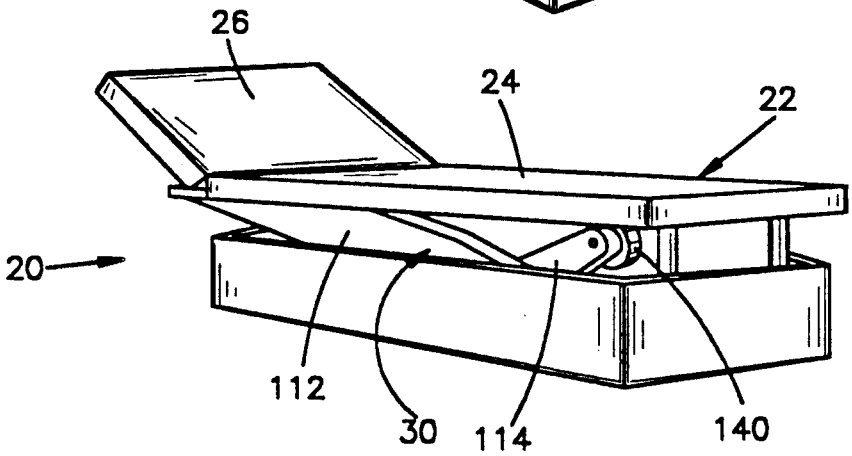
FIG. 5 is a pictorial illustration of the examination table assembly, with the housing removed, in the lowered position of FIG. 2.
Figure 7:
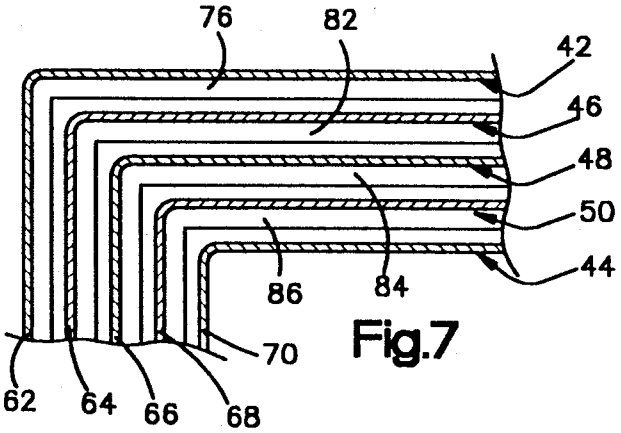
FIG. 7 is a plan view, taken generally along the line 7—7 of FIG. 6, further illustrating the relationship between the housing sections.

Upon operation of manually actuated hand controls 34 (FIG. 1), the drive assembly 30 moves the table top 22 between the fully raised position of FIGS. 1 and 3 and the fully lowered position of FIGS. 2 and 5. The hand controls 34 can be manually actuated to cause the drive assembly 30 to move the table top 22 to any desired position between the fully raised and the fully lowered positions. In addition, the hand controls 34 can be manually actuated to cause the drive assembly 30 to move the backrest 26 to any desired position between the fully lowered or horizontal position of FIG. 2 and a fully raised or vertical position.

An improved housing 38 (FIG. 1) is connected with the table top 22 and the base 30. The housing 38 encloses the drive assembly 30. When the table top 22 is raised, the housing 38 is telescopically extended. When the table top 22 is lowered, the housing 38 is telescopically retracted.

When the table top 22 is fully lowered (FIGS. 2 and 5), an individual can easily move from a wheelchair to the table top 22. Thus, when the table top 22 is in the fully lowered position, an upper side surface of the table top 22 is at a level which is lower than the height of the seat of most wheelchairs. The upper surface of the fully lowered table top 22 is at a height of approximately seventeen inches from the floor or support surface upon which the examination table assembly 20 is disposed.

When the table top 22 is in the fully lowered position of FIG. 2, it is easy for handicapped, injured, elderly and/or obese individuals to position themselves on the table top with a minimum of help. Of course, this minimizes the effort which nursing or other personnel must exert to move an individual onto the examination table. Therefore, the possibilities of injuries both to the individual and to the nursing personnel are minimized.

The backrest 26 is adjustable independently of movement of the main section 24 of the table top 22. This enables the backrest 26 to be adjusted to any desired position between a fully lowered or horizontal position (FIGS. 2 and 3), a partially upright position (FIGS. 1 and 4) and a fully upright or vertical position. This enables a patient on the examination table assembly 20 to assume a position which is comfortable and/or best for examination purposes. The backrest 26 is moved between the fully lowered and fully upright positions by operation of the hand controls 34.

To raise the table top 22 from the fully lowered position of FIG. 2, the hand controls 34 (FIG. 1) are actuated. When the table top 22 is in a fully raised position, the table top is at a height of thirty-six inches from the floor. The table top 22 can be stopped at any position between the fully lowered and fully raised positions. This enables the table top 22 to be set to a height which is most advantageous for movement of an individual onto the table top and then to be set for a height which is advantageous for examining the individual.

Housing

In accordance with one of the features of the present invention, the housing 38 has a plurality of relatively movable sections, including an upper or outer section 42 and a lower or inner section 44 (FIG. 1). A plurality of intermediate sections 46, 48 and 50 are disposed between the upper and lower sections 42 and 44. The relatively movable housing sections 42–50 are disposed in a telescopic relationship relative with each other.

As the examination table top 22 is moved downwardly from the raised position of FIG. 1 to the fully lowered position of FIG. 2, the housing sections 42–50 are telescopically retracted. Similarly, as the table top 22 is moved upwardly from the fully lowered position of FIG. 2 to the fully raised position of FIG. 1, the housing sections 42–50 are telescopically extended. As the table top 22 is moved from the raised position of FIG. 1 toward the lowered position of FIG. 2, the extent to which the housing sections 42–50 overlap each other increases. Similarly, as the table top 22 is moved from the lowered position of FIG. 2 to the raised position of FIG. 1, the extent to which the housing sections 42–50 overlap each other decreases.

Figure 10:
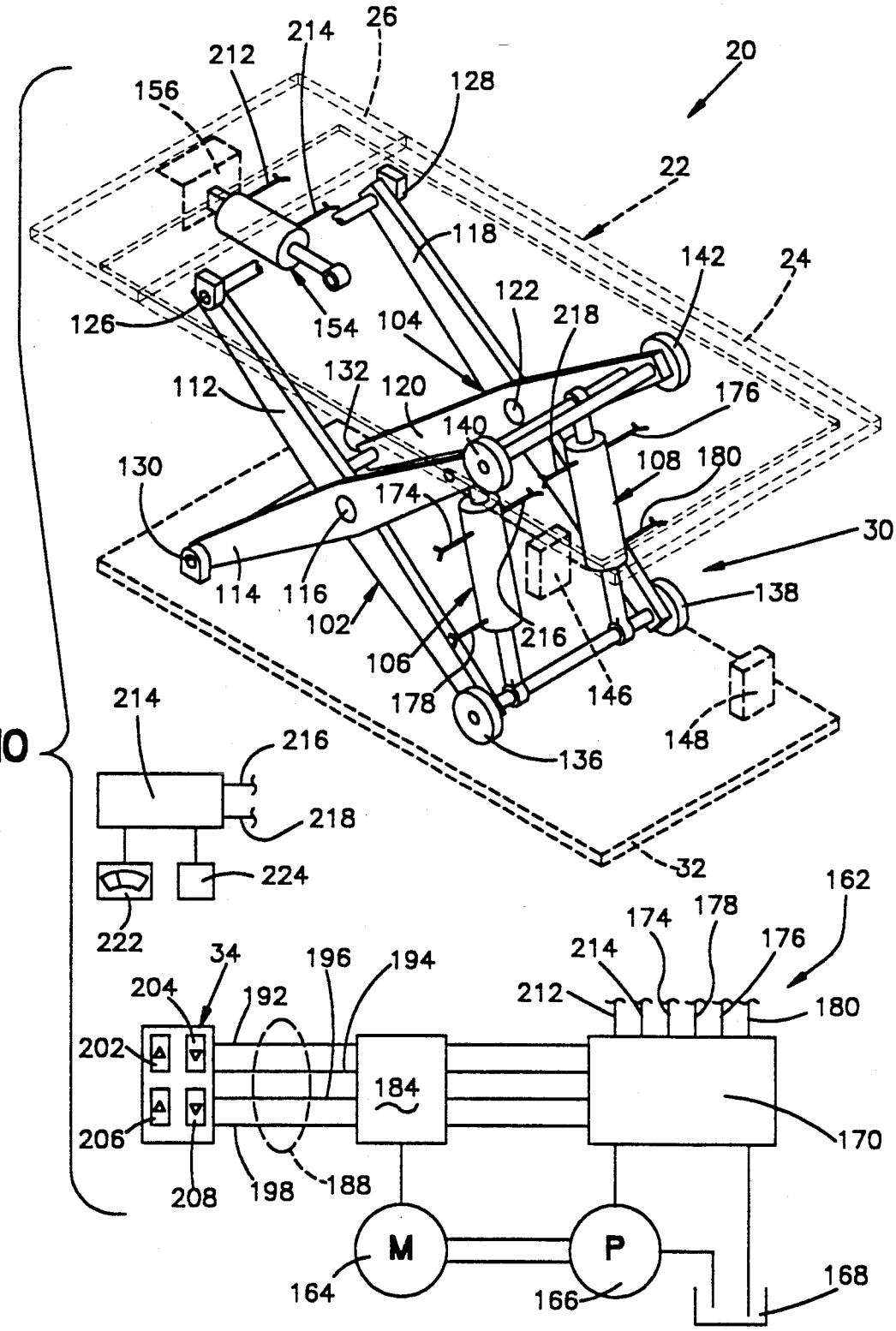
FIG. 10 is a schematic illustration depicting the relationship between a drive assembly for raising and lowering the table top and controls for the drive assembly.

When the examination table assembly 20 is in the fully raised position of FIG. 1, the housing 38 has a generally rectangular configuration and tapers downwardly from the relatively large rectangular cross section adjacent to the examination table top 22 to a smaller rectangular cross section adjacent to the base 32 (FIGS. 3 and 10). At this time, there is a minimum of overlap between each of the adjacent rectangular housing sections 42–50 (FIG. 1). However, there is some overlap between each of the housing sections 42–50 so that the side walls of the rectangular housing 38 are free of gaps or open spaces. Since the housing 38 tapers downwardly, there is little or no tendency for the housing sections 42–50 to catch on an individual or article during raising and lowering of the table top 22.

The overlap between the rectangular housing sections 42–50 is a maximum when the examination table assembly 20 is in the fully lowered position (FIG. 2). When the examination table assembly 20 is fully lowered (FIG. 2), the rectangular upper or outer housing section 42, which is connected to the table top 22, overlaps the rectangular lower or inner housing section 44 and the rectangular intermediate housing sections 46, 48 and 50. The lower or inner housing section 44 is fixedly connected to the stationary base 32 (FIG. 10) of the examination table assembly 20.

Figure 6:
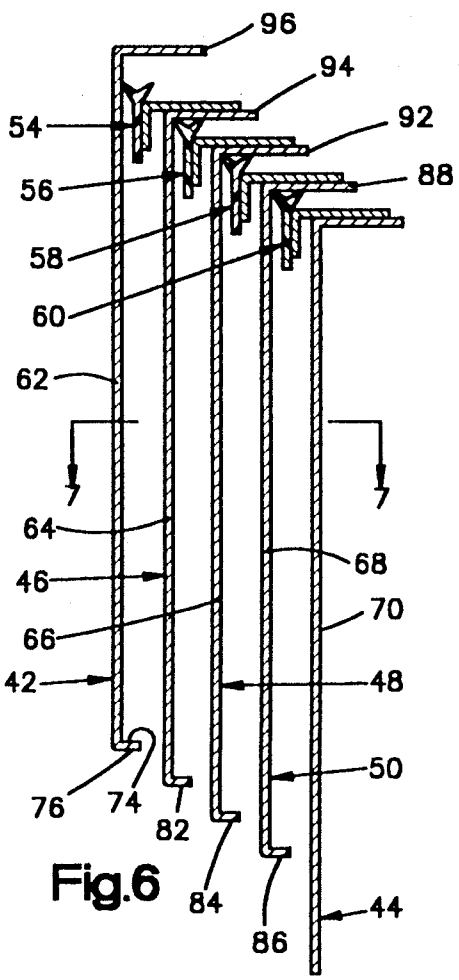
FIG. 6 is a sectional view, illustrating the relationship between sections of the housing, the housing sections being shown telescopically retracted.

Relative movement between the rectangular housing sections 42–50 during raising and lowering of the examination table top 22 is guided by a plurality of guide members 54, 56, 58 and 60 (FIGS. 6 and 8) which are fixedly connected with the housing sections. The guide members 54–60 slidably engage or wipe along flat inner side surfaces of the housing sections 42, 46, 48 and 50 during telescopic extension and retraction of the housing assembly 38. Thus, the guide members 54–60 engage rectangular metal panels 62, 64, 68 and 70 of the housing sections 42-50 (FIGS. 6 and 8) to guide relative movement between the housing sections.

The guide member 54 (FIG. 9) is provided with an outwardly extending guide or positioning section 60 which wipes along the inner side surface of the panel 62 (FIG. 6) which is fixedly connected to the table top 22. The guide member 54 guides movement of the upper or outer housing section 42 relative to the adjacent intermediate housing section 46. Similarly, the guide member 56 (FIG. 6) guides movement of the intermediate housing section 46 relative to the adjacent intermediate housing section 48. The guide member 58 guides movement of the intermediate housing section 48 relative to the intermediate housing section 50. Finally, the guide member 60 guides movement of the intermediate housing section 50 relative to the stationary lower or inner housing section 44.

The guide member 54 has a metal base 71 which is fixedly connected with the housing section 46. A body portion 72 of the guide member 54 is bonded and mechanically connected with the base 71. The body portion 72 of the guide member 54 is formed of a suitable polymeric material. The guide section 60 is deflected by engagement with the housing section 42 to provide firm engagement with the housing section.

Figure 9:
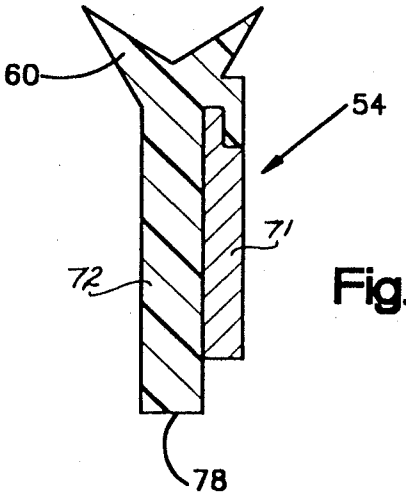
FIG. 9 is an enlarged sectional view of a guide element which is mounted on one of the housing sections.

Although only one of the guide members 54 has been shown in FIG. 9, it should be understood that the other guide members 56, 58 and 60 have the same construction as the guide member 54. It should also be understood that although only one guide member 54–60 has been shown in FIGS. 6 and 8 as being mounted on each of the rectangular housing sections 44, 46, 48 and 50, a plurality of the guide members are mounted on each of the housing sections. Specifically, the rectangular lower housing section 44 is provided with eight guide members adjacent to the corners of the housing section. Thus, a guide member is provided adjacent to each of the two opposite sides of each corner of the rectangular lower housing section 44.

In addition, a pair of guide members are provided along each of the two parallel and relatively long major sides of each of the rectangular housing section 44. However, only one guide member is provided along each of the two parallel and relatively short minor sides of each of the rectangular housing section 44. Guide members are mounted on the housing sections 46, 48 and 50 at locations corresponding to locations where guide members are mounted on the housing section 44. It should be understood that any desired number of guide members could be associated with each of the housing sections 44–50. Although it is preferred to provide guide members having a relatively short longitudinal extent along the housing sections, for example a length of approximately three inches, the guide members could be coextensive with the longitudinal extent of the sides of the housing sections 44–50 if desired.

Figure 4:
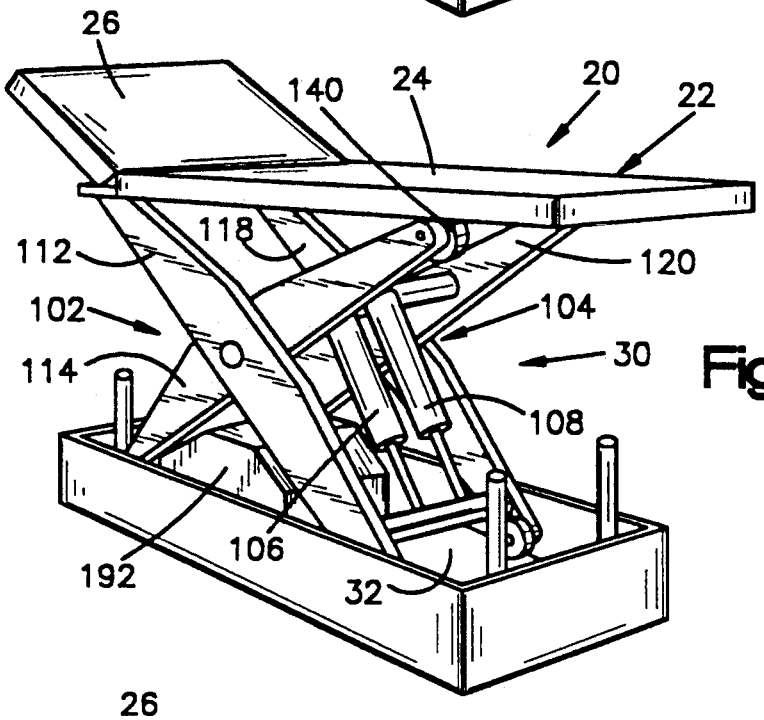
FIG. 4 is a pictorial illustration, generally similar to FIG. 3, with a table top backrest partially raised.

When the drive assembly 30 is actuated to raise the table top 22 from the lowered position of FIG. 5 to the raised position of FIG. 4, the upper or outer housing section 42 (FIG. 6) moves upwardly with the table top 22 to which it is fixedly secured. As the upper or outer housing section 42 is raised, a lift surface 74 on an inwardly projecting lip 76 at the lower edge of the housing section 42 (FIG. 6) moves upwardly toward the stationary guide member 54. As the table top 22 continues to be raised, the lift surface 74 on the inwardly projecting lip 76 of the upper or outer housing section 42 abuttingly engages a stop surface 78 (FIG. 9) on a lower end portion of the guide member 54.

Figure 8:
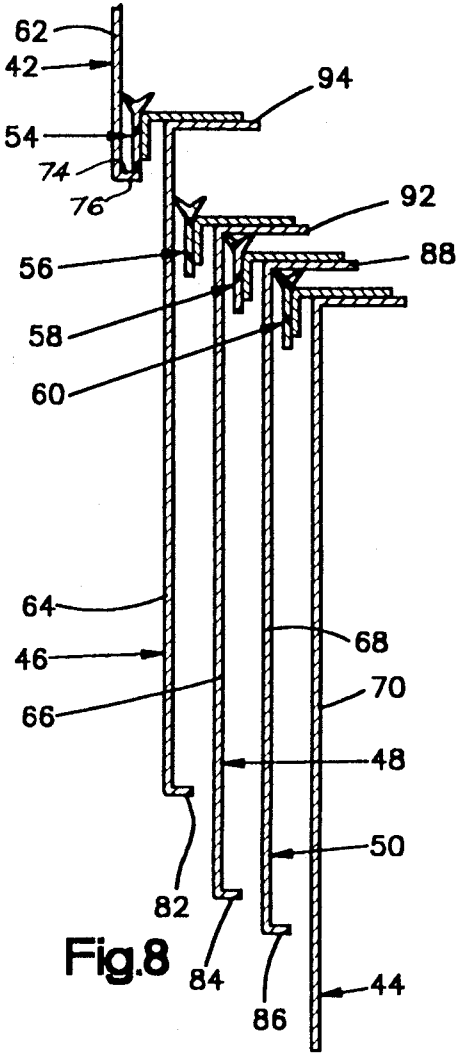
FIG. 8 is a sectional view, generally similar to FIG. 6, illustrating the relationship between the housing sections when the table top has been partially raised.

As the drive assembly 30 continues to raise the table top 22, the outer or upper section 42 of the housing pulls the intermediate section 46 of the housing upwardly (FIG. 8). Thus, force is transmitted from the table top 22 to the outer or upper housing section 42 which is connected to the table top. This force is transmitted from lift surface 74 (FIG. 6) on the in-turned lip 76 of the upper housing section 42 to the stop surface 78 (FIG. 9) on the guide member 54. The guide member 54 is fixedly secured to the intermediate section 46 (FIG. 6) of the housing. Therefore, the force applied to the guide member 54 by the lip 76 on the lower portion of the outer housing section 42 pulls the outermost intermediate section 46 upwardly (FIG. 8) with the table top 22.

As the upward movement of the table top 22 continues, an inwardly projecting lip 82 (FIG. 8) on the intermediate housing section 46 engages the guide member 56 secured to the next adjacent housing section 48. Continued upward movement of the table top 22 pulls the intermediate housing section 48 upwardly along with the housing sections 42 and 46 under the influence of force transmitted from the table top. As the table top 22 continues to be raised, an in-turned lip 84 on the intermediate housing section 48 engages the guide member 58 connected to the innermost intermediate housing section 50 to raise the intermediate housing section 50 along with the housing sections 42, 46, and 48.

When the table top 22 reaches a fully raised position, the in-turned lip 86 at the lower end of the housing section 50 will be immediately adjacent to and slightly below the guide member 60 on the lower or inner housing section 44. The lower housing section 44 is fixedly secured to the base and is stationary. Therefore, the lip 86 on the housing section 50 does not apply any force against the guide member 60. Upward movement of the table top 22 is interrupted before the lip 86 on the housing section 50 engages the guide member 60 secured to the housing section 44.

When the table top 22 is lowered from the fully raised position of FIG. 1, an inwardly extending lip 88 (FIGS. 6 and 8) on the intermediate housing section 50 moves downwardly into engagement with a support surface on the stationary guide member 60. Of course, once the upper lip 88 on the housing section 50 engages the guide member 60, further downward movement of the housing section 50 is blocked by the guide member. Similarly, during continued downward movement of the table top 22, an in-turned lip 92 on the housing section 48 moves into abutting engagement with a support surface on the guide member 58 connected to the intermediate housing section 50. Still further downward movement of the table top 22 moves an in-turned lip 94 on the housing section 46 into engagement with a support surface on the guide member 56. Downward movement of the table top 22 is interrupted before an in-turned lip 96 on the outer or upper housing section 42 engages the stationary guide member 54.

The guide members 54–60 are provided with guide surfaces to guide relative movement between the housing sections 42–50. The guide members 56, 58 and 60 are also provided with support surfaces to support the intermediate housing sections 46, 48 and 50 when the housing assembly 38 is in the fully retracted or lowered position shown in FIG. 6. The guide members 54, 56 and 58 are also provided with lower end surfaces which are engaged to pull the intermediate housing sections 46, 48 and 50 upwardly.

Thus, the guide members 54, 56, 58 and 60 perform the functions of guiding relative movement between the housing sections 42, 44, 46, 48 and 50, transmitting lifting forces between the housing sections 42, 46, 48 and 50, and supporting the housing sections 46, 48 and 50.

Drive Assembly

The drive assembly 30 includes a pair of support linkages 102 and 104 (FIGS. 3, 4 and 10). The support linkages 102 and 104 are interconnected between the table top 22 and base 32 (FIG. 10). Piston and cylinder assemblies 106 and 108 are provided to actuate the support linkages 102 and 104 to raise and lower the table top 22.

The support linkage 102 includes a pair of rigid metal links 112 and 114 which are pivotally interconnected at a center pivot 116. Similarly, the support linkage 104 includes a pair of rigid metal links 118 and 120 which are pivotally interconnected at 122. The upper ends of the support links 112 and 118 are pivotally connected at 126 and 128 with the table top 22. The lower ends of the support links 114 and 120 are pivotally connected at 130 and 132 with the base 32.

Rollers 136 and 138 are provided at the lower ends of the support links 112 and 118 to roll along the base 32. Similarly, rollers 140 and 142 are provided at the upper ends of the support links 114 and 120 and roll along the underside of the table top 22. A pair of stops 146 and 148 are fixedly connected to the base 32 to engage the roller 138 at the limits of movement of the table top 22. Thus, when the table top 22 is fully lowered, the roller 138 engages the stop 148. Similarly, when the table top 22 is fully raised, the roller 138 engages the stop 146. The stops 146 and 148 are fixedly secured to the base 32.

To raise the table top 22 from the fully lowered position of FIG. 5 to the fully raised position of FIG. 4, the piston and cylinder assemblies 106 and 108 are operated from a fully retracted condition to a fully extended condition. As this occurs, the rollers 136 and 138 (FIG. 10) roll along the base 32 and the rollers 140 and 142 roll along the bottom surface of the table top 22. The support links 112 and 114 pivot about the connection 116 with a scissors action. Similarly, the support links 118 and 120 pivot about the connection 122. When the table top 22 reaches the fully raised position, the roller 138 engages the stop 146 to block further operation of the piston and cylinder assemblies 106 and 108.

When the table top 22 is to be moved from the fully raised position of FIGS. 3 and 4 to the fully lowered position of FIG. 5, the piston and cylinder assemblies 106 and 108 are retracted. This causes the rollers 136 and 138 to roll along the base 132 and the rollers 140 and 142 to roll along the bottom surface of the table top 22. When the table top 22 has been moved to the fully lowered position, the roller 138 engages the stop 148 to block further movement of the roller 138 and further lowering of the table top.

The backrest 26 is pivoted between the lowered or horizontal position of FIGS. 2 and 3 and a fully upright or vertical position by operation of a piston and cylinder assembly 154 (FIG. 10). The head end of the piston and cylinder assembly 154 is pivotally connected to a bracket 156 which is fixedly secured to the bottom of the backrest 26 and extends downwardly from the backrest. When the piston and cylinder assembly 154 is extended from the fully retracted position 10, the backrest 26 is pivoted upwardly about a hinge connection with the main section 24 of the table top 22. Since the backrest 26 is adjusted or moved by a piston and cylinder assembly 154 which is separate from the piston and cylinder assemblies 106 and 108, the position of the backrest can be adjusted independently of the position of the table top 22.

A control assembly 162 is operable to control the movement of the table top 22 and backrest 26. The control assembly includes an electric motor 164 which drives a pump 166. The pump 166 supplies hydraulic fluid from a reservoir 168 to a control valve assembly 170. The control valve assembly 170 is connected to the head ends of the piston and cylinder assemblies 106 and 108 by conduits 174 and 176. The valve assembly 170 is connected to the rod ends of the piston and cylinder assemblies 106 and 108 by conduits 178 and 180.

A pressure responsive switch assembly 184 controls the operation of the valve assembly 170 and the motor 164. The switch assembly 184 is connected with the hand controls 34 through a flexible conduit 188. The motor 164, pump 166, reservoir 168, valve assembly 170, and control switch assembly 184 are all disposed within a housing 192 (FIG. 3) disposed beneath the table top 22.

Although electrical energy is conducted from the switch assembly 184 to the valve assembly 170 and motor 164, there is no electrical energy conducted between the hand controls 34 and the switch assembly 184. Therefore, if the hand controls are accidently immersed in liquid or if the cable 188 should be severed, there is no danger of electrocution of an individual on the examination table 22 or examining personnel.

The hand controls 34 are connected with the switch assembly 184 by a plurality of conduits 192, 194, 196, and 198 (FIG. 10). The conduits 192–198 are filled with fluid, specifically, air. Actuating a push button 202, 204, 206, or 208 on the hand controls 34 causes an increase in the fluid pressure in one of the conduits 192–198. The increase in fluid pressure in one of the conduits 192–198 is detected by the switch assembly 184. In response to the change in the characteristic of the fluid in a conduit 192, 194, 196 or 198, specifically, in response to a change in fluid pressure, the switch assembly 184 actuates the valve assembly 170 to effect the operation of the drive assembly 30.

For example, if the drive assembly 30 is to be operated to raise the table top 22, the button 202 is depressed. Depressing the button 202 actuates a bellows-type mechanism to increase the pressure in the conduit 192. This increase in pressure actuates a switch in the switch assembly 184 to turn on the motor 164 to drive the pump. In addition, the switch in the switch assembly 184 actuates a valve in the valve assembly 170 to direct high pressure fluid from the pump 166 to the head ends of the piston and cylinder assemblies 106 and 108 through the conduits 174 and 176. The rod ends of the piston and cylinder assemblies 106 and 108 are connected with the reservoir 168 through the conduits 178 and 180 and valve assembly 170. The fluid pressure in the head ends of the piston and cylinder assemblies 106 and 108 causes them to expand and actuates the support linkages 102 and 104 to raise the table top 22.

When the table top 22 has reached the desired position, the button 202 is released. This results in a decrease in the pressure in the conduit 192. The switch assembly 184 detects the decrease in pressure in the conduit 192 and interrupts the flow of current to the pump drive motor 164 and closes the valve to the head ends of the piston and cylinder assemblies 106 and 108.

When the examination table 22 is to be lowered, the button 204 on the hand controls is depressed. This results in an increase in the fluid pressure in the conduit 194. The increase in the fluid pressure in the conduit 194 is detected by the switch assembly 184. The switch assembly 184 again energizes the motor 164 to drive the pump 166. However, at this time, the high pressure hydraulic fluid from the pump 166 is conducted through the valve assembly 170 and conduits 178 and 180 to the rod ends of the piston and cylinder assemblies 106 and 108. The head ends of the piston and cylinder assemblies 106 and 108 are connected with the reservoir 168 by the valve assembly 170 through the conduits 174 and 176.

When the table top 22 has been lowered to the desired extent, the button 204 is released and the pressure in the conduit 194 decreases. The resulting decrease in fluid pressure in the conduit 194 causes the switch assembly 184 to de-energize the electric motor 164 and to actuate the valve assembly 170 to block fluid flow to and from the piston and cylinder assemblies 106 and 108.

The hand controls 34 can be acuated in a similar manner to raise and lower the backrest 26. Thus, the valve assembly 170 is connected with the head end of the piston and cylinder assembly 154 through a conduit 212 and is connected with the rod end of the piston and cylinder assembly 154 through a conduit 214. Upon actuation of a button 206 on the hand controls 34, the fluid pressure in the conduit 196 is increased. This increase in fluid pressure is detected by the switch assembly 184 which energizes the pump drive motor 164 and actuates the valve assembly 170 to direct high pressure fluid through the conduit 212 to the head end chamber of the piston and cylinder assembly 154. The valve assembly 170 connects the rod end chamber of the piston and cylinder assembly 154 to reservoir through conduit 214. This causes the piston and cylinder assembly 154 to expand and pivot the backrest 26 upwardly toward a vertical orientation.

When it is desired to lower the backrest 26, the button 208 in the hand controls 34 is depressed. Depressing the button 208 increases the fluid pressure in the conduit 198. In response to the increase in fluid pressure in the conduit 198, the switch assembly 184 again energizes the pump motor 164. The valve assembly 170 is actuated to connect high pressure fluid from the pump 166 to the rod end chamber of the piston and cylinder assembly 154 through the conduit 214 and to connect the head end chamber with the reservoir 168 through the conduit 212.

The control assembly 162 and the piston and cylinder motors 106, 108, and 154 are commercially available from Hypac Inc., Hydraulics Systems, Route 2, Box A1, Flemingsburg, Ky. 41041. The piston and cylinder assemblies 106, 108 and 154, motor 164, pump 166, valve assembly 170, and switch assembly 184 are sold by Hypac Inc. under product No. 20 24503. The hand controls 34 and cable 188 are sold by Hypac Inc. under product No. 10 84235. Of course, other controls and piston and cylinder assemblies could be used if desired.

It is contemplated that it may be desirable to weigh an individual who is disposed on the examination table assembly 20. This may be done by determining the hydraulic fluid pressure which is present in the head end chambers of the piston and cylinder assemblies 106 and 108. Thus, the greater the weight of the individual on the examination table assembly 20, the greater will be the fluid pressure in the head end chamber of the piston and cylinder assemblies 106 and 108.

To weigh an individual on the table top 22, a load cell 214 is connected with the head end chambers on the piston and cylinder assemblies 106 and 108 through conduits 216 and 218. The load cell 214 has an output which varies as a function of the fluid pressure conducted to the load cell through the conduits 216 and 218. A visual readout device 222 is connected with the load cell 214 and provides a visual indication of the weight of an individual on the examination table top 22. In addition, a computer 224 is connected with the load cell. The computer 224 stores a reading corresponding to the weight of the individual and, at a later time, provides a printout indicative of the weight.

Conclusion

In view of the foregoing description, it is apparent that the present invention relates to a new and improved examination table assembly 20 having a table top 22 which can be raised and lowered. A housing 38 encloses a drive mechanism 30 which raises and lowers the table top 22. The housing 38 includes a plurality of sections 42–50 which are disposed in a telescopic relationship relative with each other. When the table top 22 is raised, the housing sections 42–50 are telescopically extended. When the table top 22 is lowered, the housing sections 42–50 are telescopically contracted.

A manually actuatable control 34 for the drive assembly 30 is connected with the drive assembly by flexible conduits 192–198 containing fluid. When the table top 22 is to be raised or lowered, the pressure in the conduits 192–198 is changed to provide a control signal which effects operation of the drive assembly 30 to raise and lower the table top. A weighing apparatus 214 is connected with the table top 22 to provide an output indicative of the weight of an individual on the table top.

Having described one specific preferred embodiment of the invention, the following is claimed:

1. An examination table assembly for use during the examination of an individual, said examination table assembly comprising a base, a table top for receiving the individual to be examined, drive means connected with said base and table top for raising and lowering said table top relative to said base, housing means connected with said base and said table top for enclosing said drive means, said housing means including a plurality of relatively movable sections disposed in a telescopic relationship relative to each other, said housing sections being movable between a telescopically retracted condition when said table top is in a fully lowered position and a telescopically extended condition when said table top is in a fully raised position, said housing sections overlapping each other to a first extent when said table top is in the fully lowered position and overlapping each other to a second extent which is less than said first extent when said table top is in the fully raised position, said plurality of housing sections including a lower housing section fixedly connected to said base, an upper housing section fixedly connected to said table top and a plurality of intermediate housing sections which are at least partially disposed between said upper and lower housing sections when said table top is in the fully lowered position, said housing means having a generally rectangular configuration and tapering inwardly and downwardly from said table top to said base when said table top is in the fully raised position, each of said plurality of housing sections including a plurality of flat rectangular panel sections interconnected in a rectangular array which extends around said drive means, said flat rectangular panel sections of said upper and intermediate housing sections having straight lower edge portions which extend parallel to and are spaced apart from flat rectangular panel sections of said intermediate and lower housing sections during raising and lowering of said table top, said housing means further including a plurality of guide means which are connected with upper portions of said intermediate and lower housing sections for engaging the flat rectangular panel sections of said intermediate and upper housing sections and for guiding relative movement between said housing sections during raising and lowering of said table top, said lower edge portions of said flat rectangular panel sections of said upper and at least one of said intermediate housing sections including a plurality of lift surface means for engaging surfaces connected with adjacent housing sections and for transmitting force to pull said intermediate housing sections upwardly with said table top during movement of said table top from the fully lowered position to the fully raised position.

2. An examination table as set forth in claim 1 wherein said guide means includes a plurality of guide elements which are connected with said intermediate and lower housing sections, said plurality of guide elements having downwardly facing surfaces which are engageable by said lift surface means to limit relative movement between said housing sections during raising of said table top, said plurality of guide elements having upwardly facing surfaces which are engageable with at least some of said housing sections to support at least some of said housing sections when said table top is in the fully lowered position.

3. An examination table as set forth in claim 1 wherein said drive means includes first and second support links, first pivot means for pivotally interconnecting central portions of said first and second support links, second pivot means for pivotally connecting a lower end portion of said first support link with said base, third pivot means for pivotally connecting an upper end portion of said second support link with said table top, first means for enabling an upper end portion of said first support link to move relative to said table top during raising and lowering of said table top, second means for enabling a lower end portion of said second support link to move relative to said base during raising and lowering of said table top, third and fourth support links, fourth pivot means for pivotally interconnecting central portions of said third and fourth support links, fifth pivot means for pivotally connecting a lower end portion of said third support link with said base, sixth pivot means for pivotally connecting an upper end portion of said fourth support link with said table top, third means for enabling an upper end portion of said third support link to move relative to said table top during raising and lowering of said table top, fourth means for enabling a lower end portion of said fourth support link to move relative to said base during raising and lowering of said table top, and motor means for pivoting said first and second support links at said first pivot means and for pivoting said third and fourth support links at said fourth pivot means to raise and lower said table top.

4. An examination table as set forth in claim 3 further including means for connecting a first portion of said motor means with said first end third support links for movement therewith relative to said table top during raising and lowering of said table top and means for connecting a second portion of said motor means with said second and third support links for movement therewith relative to said base during raising and lowering of said table top.

5. An examination table assembly as set forth in claim 1 wherein said drive means includes piston and cylinder means operable under the influence of fluid pressure to move said table top from the fully lowered position to the fully raised position, pump means connected with said piston and cylinder means for supplying fluid pressure to operate said piston and cylinder means, valve means for directing fluid flow to and from said piston and cylinder means, and motor means for driving said pump means, said examination table assembly further including control means for controlling the operation of said valve means and said motor means.

6. An examination table assembly as set forth in claim 5 further including weighing means connected with said piston and cylinder means for providing an output signal indicative of the weight of an individual disposed on the table top.

7. An examination table assembly as set forth in claim 3 wherein said control means includes switch means for controlling a flow of electrical current to said motor means and manually actuatable means for controlling operation of said switch means, said manually actuatable means including a plurality of conduits containing fluid and connected to said switch means, and a plurality of signal generating means for varying a characteristic of the fluid in at least one of said conduits, said switch means including means for actuating said switch means in response to a change in a characteristic of the fluid in one of said conduits.

8. An examination table assembly as set forth in claim 5 wherein said control means includes a plurality of conduits containing fluid, manually actuatable means for varying a characteristic of the fluid in at least one of said conduits, and means for operating said valve means in response to a change in the characteristic of the fluid in one of said conduits.

* * * * *

UNITED STATES PATENT AND TRADEMARK OFFICE

CERTIFICATE OF CORRECTION

PATENT NO. : 5,058,871

DATED : October 22, 1991

INVENTOR(S) : James V. Congin and William F. Meditz

It is certified that error appears in the above-identified patent and that said Letters Patent is hereby corrected as shown below:

Column 11, line 41, claim 4, change "end" to --and--.

Column 12, line 24, claim 7, change "3" to --5--.

Signed and Sealed this

Second Day of March, 1993

*Attest:*

STEPHEN G. KUNIN

*Attesting Officer*

*Acting Commissioner of Patents and Trademarks*